United States Patent [19]

Buehner

[11] 4,077,369

[45] Mar. 7, 1978

[54] INTERNAL COMBUSTION ENGINE VALVE STROKE ADJUSTING DEVICE AND COMBINATION THEREOF WITH ENGINE

[75] Inventor: Joseph F. Buehner, Wadsworth, Ohio

[73] Assignee: Joseph F. Buehner, Trustee, Wadsworth, Ohio

[21] Appl. No.: 679,004

[22] Filed: Apr. 21, 1976

[51] Int. Cl.[2] ..... F01L 1/34

[52] U.S. Cl. ..... 123/90.16; 123/90.2; 123/90.39

[58] Field of Search ..... 123/90.16, 90.2, 90.39

[56] References Cited

U.S. PATENT DOCUMENTS

| | | | |
|---|---|---|---|
| 1,440,427 | 1/1923 | Wigelius | 123/32 R |
| 2,260,983 | 10/1941 | Walker | 123/90.16 |
| 2,266,077 | 12/1941 | Roan | 123/90.16 |
| 2,670,595 | 3/1954 | Miller | 123/90.16 |
| 2,773,490 | 12/1956 | Miller | 123/90.16 |
| 2,780,912 | 2/1957 | Miller | 123/90.16 |
| 2,936,575 | 5/1960 | Lieberherr | 123/90.16 |
| 3,040,723 | 6/1962 | Scherenberg | 123/90.16 |
| 3,112,739 | 12/1963 | Peras | 123/90.16 |
| 3,138,038 | 6/1964 | Scherenberg | 123/90.16 |
| 3,367,312 | 2/1968 | Jonsson | 123/90.16 |
| 3,413,965 | 12/1968 | Gavasso | 123/90.16 |

*Primary Examiner*—Charles J. Myhre
*Assistant Examiner*—Daniel J. O'Connor
*Attorney, Agent, or Firm*—John Harrow Leonard

[57] ABSTRACT

A power driven remote control device is operable from a location remote from the engine for adjusting the length of stroke of one or more valves of an internal combustion engine during engine operation and while maintaining the valving cycle substantially unchanged. The strokes of all of the valves of the engine can be adjusted equal or preselected amounts concurrently. The control is arranged so that it can be installed on a conventional engine to provide an operating combination therewith without substantial modification of the existing engine structure. In this combination, the control utilizes fluid pressure generated by the engine, such as the oil pressure from the engine oil pump, for changing the length of valve strokes while isolating the valves from any rocking that might otherwise be imposed by the valve driving cam or tappet.

12 Claims, 7 Drawing Figures

FIG. 1
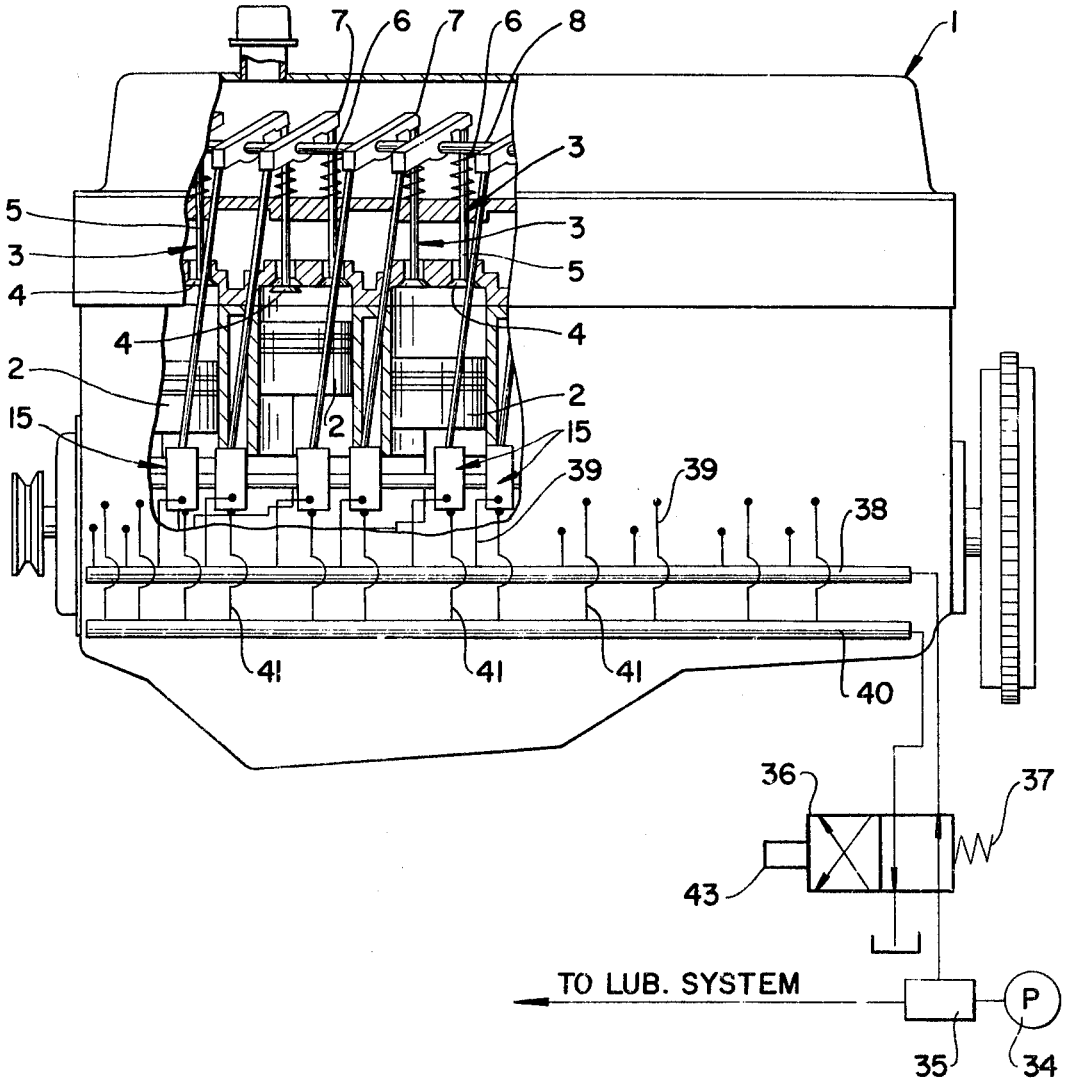
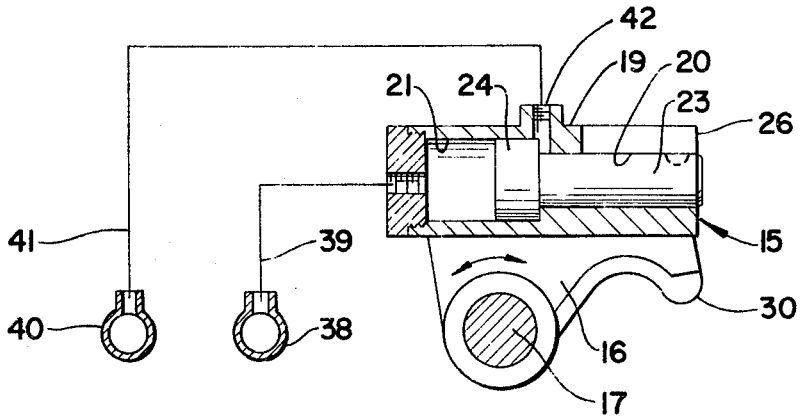
FIG. 2

FIG. 5
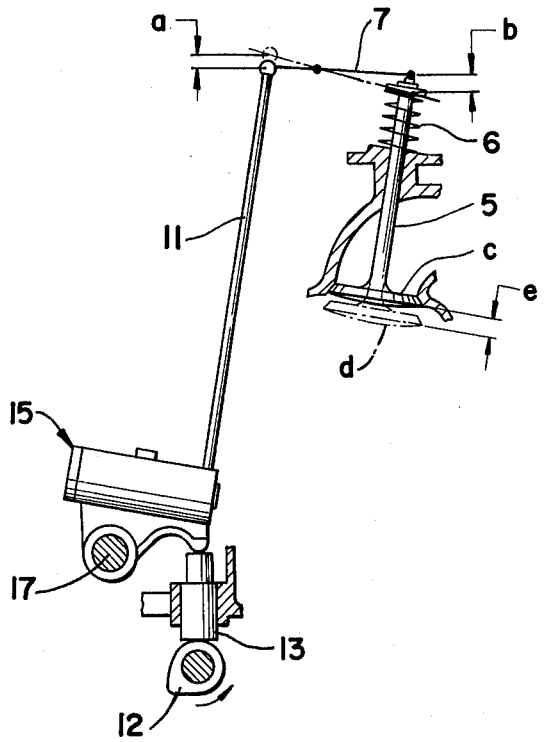
FIG. 6
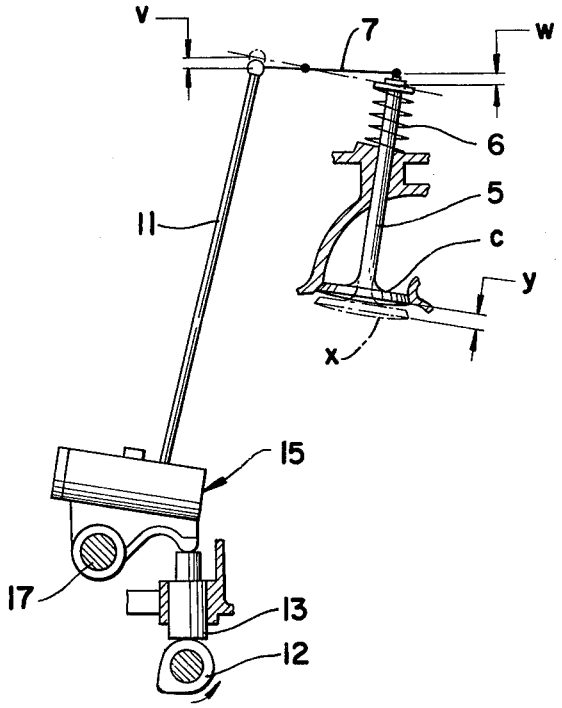
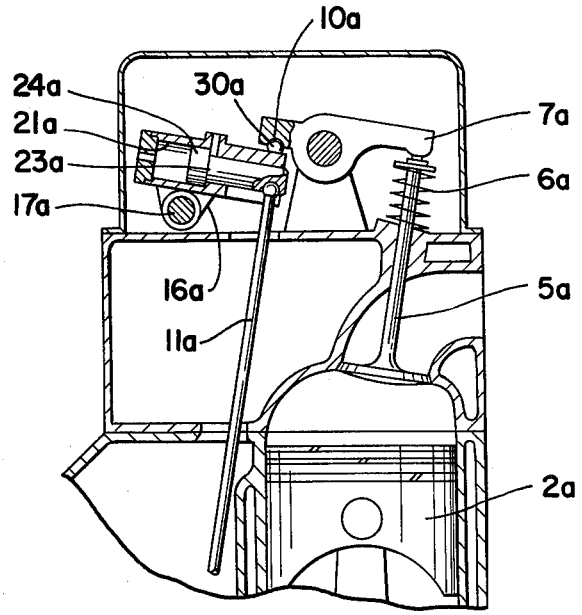
FIG. 7

INTERNAL COMBUSTION ENGINE VALVE STROKE ADJUSTING DEVICE AND COMBINATION THEREOF WITH ENGINE

BACKGROUND OF INVENTION

1. Field of Invention

Engine valve stroke adjusting devices.

2. Prior Art

Heretofore attempts have been made to modify the lengths of strokes of the valves of internal combustion engines. In most of these prior structures, the adjustment of the valve stroke necessarily involves a change in the time cycle and relation between the tappet and cam. In one instance, as disclosed in U.S. Pat. No. 1,440,427, issued Jan. 2, 1923, a valve stroke length adjustment which can function with a substantial change in the time cycle is provided. However, in that structure, an individual control is provided for each valve, and each control is arranged to be operated manually separate and apart from the others, to effect adjustment of its associated valve. Furthermore, each control is located in its entirety within the engine immediately adjacent the associated valve it is to adjust, and is very difficult of access. Again, in this prior structure, the line of thrust of the driving connection between the tappet and its associated valve stem must be shifted transversely of the stem and tappet to effect the stroke adjustment. This shift necessarily imposes rocking moments on the valve in addition to those which would normally be occasioned by the conventional driving connection between the valve and its cam. Thus not only are rocking moments from the timing cam transmitted to the valve itself, but also, additional rocking moments inherently are created by the prior control devices themselves, causing undue wear and leading to erratic timing and operation.

In the prior art mentioned, the total lift with a quarter inch cam lift ranges from about 5/32 inch maximum to a minimum of from zero to usually 3/32. Thus the usual operating range of maximum to minimum valve stroke is about 5 maximum to 3 minimum.

SUMMARY

In accordance with the present invention, these disadvantages of prior devices are overcome. The strokes of all valves can be adjusted simultaneously and from a remote location, such as at a location within the cab of the vehicle and readily accessible to the driver. Furthermore, the valve itself is isolated from any rocking action of the timing cam and driving tappet. The inertial forces developed in the valve and their cooperating reciprocating or rocking elements are reduced as the strokes are shortened, wherefore, as the valve strokes are shortened from maximum, the actual time cycle approaches progressively more nearly the theoretically optimum time cycle.

The position of the cam relative to the maximum open position of its associated valve is the same for both normal, or long, valve stroke and adjusted, or shortened, valve stroke.

Generally, in internal combustion engines, the operator has a choice, for a given fuel input, of greater power or greater speed. A smaller input of fuel with greater compression is obtained by decreasing the amount the intake and exhaust valves are opened during each cycle, thus increasing the power, but at a sacrifice in speed in relation to a unit volume of fuel. On the other hand, a larger input of fuel with lower compression is obtained by increasing the amount the valves are opened during each cycle, thus increasing the speed, but at a sacrifice in power in relation to a unit volume of fuel. The minimum valve opening with resultant higher compression is particularly useful in starting heavy engines, especially in the case of Diesel or large gasoline engines, and also for breaking loose and initiating the movement of an extremely heavy load. This setting is also desirable for slower operation imposed by traveling up a steep grade with a heavy load.

At slow engine speed with a minimum valve stroke setting, the piston can draw into the cylinder an adequate charge of fuel mixture. The advantage seems to be because primarily, at this slower speed and minimum opening, the exhaust valve stroke is also reduced, so that, even at the same spring and cam controlled rate of closure, it can reduce the effective size of the exhaust port opening more quickly. Thus it can retain the full charge longer for compression and firing due to the reduced or lesser opening, which, when the valve is fully unseated, is still adequate to permit effective exhaust of the products of combustion of the burnt out charge at the lower speed.

As in all internal combustion engines, the inertial forces in the valves and parts auxiliary thereto affect the theoretically optimum valving cycle imposed by the cam. Except insofar as these inertial forces of the valve and its cooperating reciprocating or rocking elements may affect the valving cycle, the starting of the opening operation and ending of the closing operation are unchanged for long and short stroke, only the degree of valve opening being affected.

Hence, as a result of shortening the valve strokes, the operational overlap of the intake or exhaust valves, both in opening and closing, is shortened. Consequently, by setting the valves for short stroke, while maintaining the timing gear relation unchanged, a greater compression ratio is obtained. This makes possible the use of a higher vehicle driving gear ratio, if desired, as, for example, in racing cars.

Furthermore, due to the more efficient operation and the isolation of the valve from the various rocking and turning moments transmitted or generated by the timing cam and its tappet, and also by the reciprocating valve tappet in those cases in which a reciprocating tappet is interposed between the valve stem and cam, and due to the lessened impact stresses on the valve during seating from a minimum opening on short stroke, not only is the fuel economy greater, but the valve life and the lives of auxiliary valve operating interponents between the cam and valve stem are increased.

Various other objects and advantages of the present invention will become apparent from the following description in which reference is made to the drawings.

BRIEF DESCRIPTION OF THE DRAWINGS

FIG. 1 is a fragmentary side elevation of an internal combustion engine with the specific valve stroke control device of the present invention combined therewith, part of the engine being broken away to show more clearly the relation of the cooperating parts in the combination;

FIG. 2 is an enlarged diagrammatic longitudinal sectional view of the engine and valve control device, showing its valve control piston and related parts;

FIG. 5 is a diagrammatic illustration of the engine and valve stroke control showing the operation relations effected by the structure in FIG. 3;

FIG. 6 is a diagrammatic illustration similar to FIG. 5 showing the operating relations effected by the structure in its adjusted position illustrated in FIG. 4; and FIG. 7 is a view similar to FIG. 3 illustrating a modification of the invention.

Figure 3:
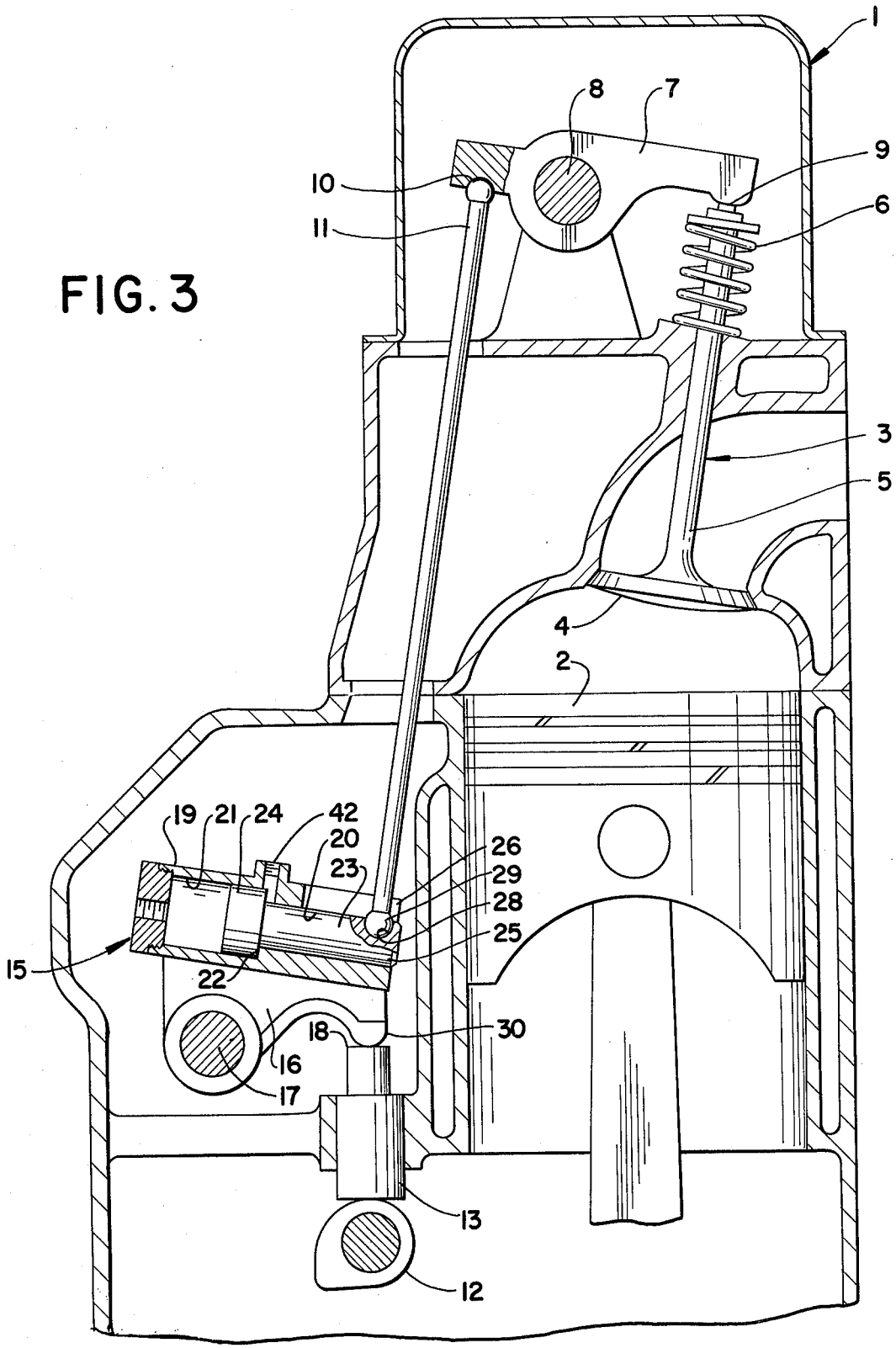
FIG. 3 is an enlarged fragmentary vertical sectional view of the engine and specific valve control device of FIG. 1, showing the control device set for normal valve stroke.

Referring to the drawings, the specific control is shown, for purposes of illustration, as installed on a conventional six cylinder internal combustion engine 1, such as commonly used in trucks. The engine includes a plurality of cylinders 2 having overhead poppet valves 3. The valves 3 are arranged in pairs, two for each cylinder, one being an intake valve and one being an exhaust valve.

Since the structure and functioning of the stroke length control device is the same in each instance, only one valve and its control device is referred to in detail herein.

As illustrated in FIGS. 1 and 3, each valve 3 has a head 4 and stem 5, and is normally seated by a suitable return or seating spring 6. The valve is opened by a rocker 7 which is rockable about a fixed pivot 8 of which the axis is preferably directly opposite, and in the same horizontal plane as the point of contact, indicated at 9, of one arm of the rocker 7 with the upper end of the valve stem 5. The other arm of the rocker is provided with a suitable socket 10 in which is received the upper end of a push rod 11. The lower end of the push rod 11 is lifted and lowered through a suitable driving train by a conventional timing cam 12. In general, the cam 12 has a gradual rise for opening the valve and a rapid drop-off to permit seating of the valve 3 by its spring 6. Generally, as illustrated, the cam 12 drives a lineally reciprocable tappet 13 which engages the lower end of the rod 11 for lifting the rod in response to the rise in the cam 12 and for permitting the rod to be lowered at the drop off of the cam by the force of the spring 6.

The structure above described is conventional, but provides for no adjustment of the length of the valve stroke.

In accordance with the present invention, a valve stroke control device, indicated generally at 15, is provided for changing the length of the valve stroke. This control comprises a rocker 16 mounted on a pivot 17 of which the axis is preferably diametrally opposite from, and in the same horizontal plane as, the original valve stem engaging contact surface 18 of the tappet 13. Mounted rigidly on the rocker 16 is a hydraulic cylinder 19 having one bore 20 and a coaxial larger bore 21, and with a shoulder 22 between the bores. Mounted within the bores is a piston, indicated generally at 23, having a head 24 disposed in the bore 21 and a stem 25 disposed in the bore 20. At its upper side the cylinder has a slot 26 leading from the outside of the cylinder into the bore 20, thus exposing a portion of the upper circumferential surface of the outer end portion of the stem 25. This outer end portion is provided with a socket 28. The lower end of the rod 11 extends, endwise, transversely of and through the slot 26 and has a spherical portion 29 which seats in the socket 28 with operating clearance.

Figure 4:
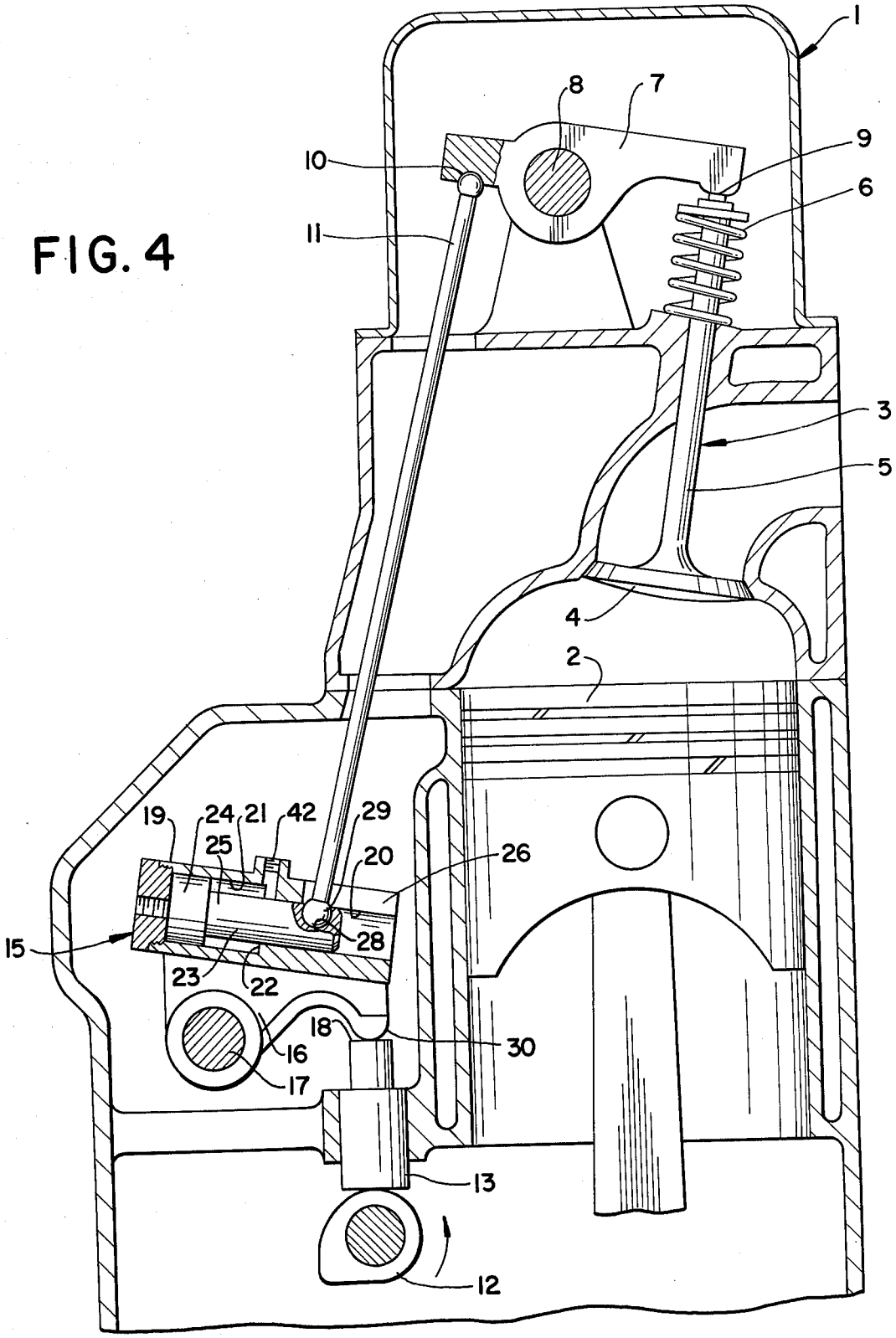
FIG. 4 is a view of the engine shown in FIG. 3, showing the valve control device set in its adjusted position for a reduced valve stroke.

With the piston seated at its extreme right hand position in FIG. 3, the rod 11 assumes its normal or conventional angle with respect to the rocker 16. The rocker 16 is provided with a spherical contact head 30 which engages the contact surface 18 of the tappet 13 in the same manner as the tappet was conventionally engaged by the lift rod, such as the push rod 11 of the valve, in the absence of the present invention. Thus, in the position of the parts illustrated in FIG. 3, the head 30 is in alignment with the axis of the rod 11 and the stroke control device operates the valve in the normal manner. However, the piston may be moved to a retracted position, as illustrated in FIG. 4, in which position the socket 28 and the lower end 29 of the rod 11 are shifted outwardly away from the line of thrust of the tappet 13 to a position toward the axis of the pivot 17 of the rocker 16. Obviously, since the lower end of the rod has been shifted to the left from the normal stroke length position illustrated in FIG. 3 to the shortened stroke length position illustrated in FIG. 4, by shifting of the piston 23, the line of thrust of the lift rod 11 passes nearer to the axis of the pivot 17 than it did in its normal stroke position. The line of thrust being closer to the axis of the pivot 17, and the rocker being operated the same as theretofore, the rocker obviously imposes less endwise movement on the rod in the short stroke position. However, the valve is to have the same seating position when the stroke length is adjusted for the normal stroke as well as when it is adjusted for the shortened stroke. Accordingly, the cylinder 19 has its axis arranged to slope at an angle to a line drawn between the axis of the pivot 17 and the surface 18 of the tappet 13 in the normal closed position of the valve. This angle is for compensation for the arcuate path of the lower end of the rod as it is swung about its upper end to move the lower end to the left to shorten the valve stroke while the valve closure remains unchanged. The angle selected is such that in the retracted position and extended position of the piston, the long and short stroke positions of its lower end lie, respectively, at the point of intersection of a chord of a circle defined by said lower end as the rod is swung about its upper end. The angle chosen is, of course, dependent upon the length of the rod in the particular engine and the selected distance from the short stroke to the normal stroke positions of the lower end of the rod 11.

Consequently, the adjustment of the rod 11 as it is swung from the position illustrated in FIG. 3 to that illustrated in FIG. 4 does not change the closed position of the valve. However, by shifting the lower end of the rod from the normal open position of the valve to the shortened stroke position illustrated in FIG. 4, a position nearer to the rocking axis of the rocker arm 16, the movement of the rod axially by the rocker 16 is reduced, thereby reducing the length of stroke of the valve and hence changing the maximum open position for a given setting.

It is to be noted that the tappet 13 is subjected to the usual rocking moments imposed by the cam 12 transversely of the tappet axis. However, this rocking action of the tappet is isolated from the valve by the rocker 16 which isolates the rocking action of the tappet that theretofore would have been transferred to the valve, from the rod 11. Again, the tendency toward any rocking movement of the rod 11 by the rocker 16 is isolated from the valve, first by the greatly reduced components of movement of the rocker 16 transversely of the rod 11, and second by the conventional rocker 7.

As mentioned, this compensating angularity of the axis of the cylinder 19 relative to the swing of the rod about its upper end is such that there is practically no difference, allowing for the normal clearances in the working parts, in the seating of the valve 3 regardless of the shifting of the rod 11.

It is desirable, as mentioned, to adjust the length of stroke from a point remote from the engine; for example, from a location readily accessible to the operator and within the cab of the vehicle. A convenient and economical manner of shifting the piston 23 for effecting this stroke adjustment is by fluid pressure derived from the vehicle engine, and preferably hydraulic pressure fluid. The normal lubricating oil pressure delivered by the usual pump driven by the engine is an adequate source for this purpose.

As illustrated in FIG. 1, the engine drives its lubricating oil pump 34 in the usual manner and the output of the pump passes through a pressure regulator 35. Since this pressure is regulated and there is adequate flow for the present operation, the pressure regulator is connected to a reversing valve 36 which preferably is biased by a spring 37 to a position for normal length of valve stroke. In this position, the flow of pressure fluid from the regulator 35 passes into a manifold 38 which is connected by suitable tubes 39 to the bores 21 of the cylinders 19, respectively. Another manifold 40 is connected to the return side of the valve 36, in the valve position illustrated in FIG. 1, and is connected by suitable tubes 41 to the bores 21 through suitable ducts 42 in the cylinders 19, respectively. Thus with the reversing valve 36 set in the position illustrated in FIG. 1, each of the pistons is in the position illustrated in FIG. 3, and the rods 11 are set for normal full stroke. Upon operation of the valve 36, all of the pistons are moved to the positions illustrated in FIG. 4, concurrently, thus setting the rods 11 for the shortened, or minimum stroke, of all of the valves concurrently.

Since it is desired to adjust the stroke while the engine is operating; for example, while the vehicle is traveling along the road, the reversing valve 36 may be operated by a drive motor 43. For example, this motor may be hydraulically driven by the pressure from the pump 34 through a suitable pilot valve, or the motor 43 may be a solenoid which, when energized, drives the valve to a position to connect the manifold 40 to the pressure side of the pump and the manifold 38 to the return side. In either event, the motor can be remotely controlled. The motor 43 can remain operative so long as the short stroke setting is desired, or an oppositely operating fluid motor or solenoid can be substituted for the spring 37 so that the valve remains in the position into which driven by the last to be operated of the motors or solenoids.

As illustrated in FIG. 5, it will be seen that in a control device setting such as shown in FIG. 3, the amount of lift of the rod 11, indicated at *a*, causes the valve stem to be depressed by an amount *b*, thus moving the valve from a closed position *c*, to a full open position *d*, in which the distance of the valve head from the seat is indicated at *e*.

As illustrated in FIG. 6, in which the rod 11 has been moved to the position illustrated in FIG. 4, the lift of the rod 11, indicated at *v*, is less than that indicated at *a*. Correspondingly, the amount of depression of the stem of the valve, indicated at *w*, is less than that indicated at *b*, thus moving the valve head from the closed position *c* to the open position *x* so that it is at a distance *y* from the seat, this distance being less than the distance *e*. Therefore, the length of stroke of each valve is changed without changing the seating or closed position, and without changing the timing relation of the engine and valves, except insofar as inertial forces cause the valve cycle to deviate from the theoretical optimum. At the same time, each valve is isolated from rocking or turning moments imposed by or between the cam 12 and the valve stem.

In some engines, the cam drop off is so rapid that, at moderate through high speeds, the cam recedes faster than the springs can return the valve. Hence the speed at which the valve approaches seating position is no longer controlled by the cam. In such cases, since the short stroke has not lifted the valve as far from the seat as the long stroke, the valve has less distance to travel to reseat and hence the valve, being free of the cam, can seat sooner in the cycle on short stroke than on long stroke. Also, the inertial forces urging the valve in the opening direction are greater at long stroke. This is because, on the long stroke, the valve is moved in the opening direction at greater velocity than at short stroke. The reduced inertial forces also tend to let the valve seat more rapidly at short stroke.

Referring to FIG. 7, the same general structure as heretofore described is shown, and the parts therein are designated with like numerals as in FIGS. 1–6, but with a suffix *a*. In this form, a rocker 16*a*, corresponding in all respects to the rocker 16 heretofore described, and mounted on a like pivot 17*a*, supplants the rocker 16 and its pivot 17. The rocker 16*a* is interposed between the upper end of the rod 11*a* and the rocker 7*a*, which corresponds to the rocker 7. Further, instead of the contact member 30 on the rocker 16 engaging the tappet, the contact member 30*a* is disposed upwardly and engages a socket 10*a* of the rocker 7*a*. The rocker engaging surface of the member 30*a* has its point of contact with the socket 10*a* of the rocker 7*a*, preferably in a horizontal plane through the rocking axis of the rocker. The adjusting piston 23*a* of the rocker 16*a* functions in the same general manner as the piston 23, but in reverse. Thus, in FIG. 3, the longest stroke of the valve in the opening direction occurs when the lower end of the rod 11 is farthest from the axis 17 of the rocker 16. In FIG. 7, the longest stroke of the valve in the opening direction occurs when the upper end of the rod 11*a* is moved closest to the axis 17*a* of the rocker 16*a*, and the stroke is shortened as the upper end of the rod 11*a* is moved farther away from the axis 17*a*. This is because the endwise travel of the rod 11*a* is substantially constant, and for its given travel it rocks the rocker 16*a* farther counterclockwise as the upper end is moved nearer to the axis 17*a*.

The adjustment described in generally adequate for all operating conditions against the bias of its seating spring. For example, the shifting of the piston from an outermost or normal length of stroke position in FIG. 3 to the retracted or innermost position in FIG. 4, a distance of about $\frac{5}{8}$ inch, is generally adequate with a rod having a length of 7 27/32 inches. However, if a greater adjustment is required, this can be obtained by pivoting the rocker arm 17*a* at a different position transversely of the axis or by shifting the position of the pivot 17*a* to a different preselected position at the time of installation. Obviously, in this connection, the closer the axis of the pivot 17*a* to the axis of the rocker 7*a*, assuming the same lift of the member 30*a*, the closer will be the open valve to its seat, because the force applied by the member 30*a* is at the end of a shorter lever arm of the rocker *7a* while the valve stem is at the end of the same lever arm of the rocker *7a* as theretofore.

While in the illustrative example, the control device is shown as controlling all of the valves concurrently, manifolds and like circuits can as readily be arranged to control the strokes of intake valves independently of exhaust valves, or to control exhaust valves only, so as to admit freely the normal charge of fuel and yet increase the compression.

Further, by selecting a different stroke of the pistons 23 for exhaust valves as compared to intake valves, one set can be made to adjust through a different range of length of stroke than the other set.

Having thus described my invention, I claim:

1. A valve stroke control device for an internal combustion engine having a valve, a timing gear train, a rotatable cam driven by the train, transmission means driven by the cam from a starting closed valve position in one direction in which one direction the transmission means transmits thrusts of the cam so as to open the valve, and movable in an opposite direction in which the transmission means returns to starting position so as to permit closing of the valve; and spring means for returning the valve from open to closed position and the transmission means from open valve position to its said starting position;

said transmission means including a stroke control device comprising:

a first rocker;

first pivot means adapted for pivotally connecting the first rocker to the engine for rocking about a pivotal axis fixed in relation to the engine;

said first rocker having a thrust portion spaced a fixed distance from said pivotal axis and through which the driving forces of the cam can be applied to the first rocker for rocking the first rocker about its said pivotal axis in a valve opening direction in timed coordination with the rotation of the cam, and having a transmitting portion spaced from said thrust portion;

a second rocker for moving the valve to open position and for controlling its return;

second pivot means adapted for pivotally connecting the second rocker to the engine for rocking about a pivotal axis fixed in relation to the engine and spaced from said first pivotal axis;

said second rocker having a transmitting portion spaced from its said pivotal axis and through which the driving force of the cam can be transmitted from the first rocker when the first rocker is rocked in its valve opening direction, and having a valve operating portion spaced from its said transmitting portion;

stroke adjusting means including a movable element mounted on one of said rockers for rocking therewith and for movement in directions generally transversely of the pivotal axis thereof, one of which directions is from a normal stroke position spaced a predetermined distance from said pivotal axis of said one rocker to a changed stroke position which is spaced from said last mentioned axis a different distance than said predetermined distance, and the other of which directions is from said changed position to said normal stroke position;

the transmitting portion of said one of said rockers being on said element;

connecting means connected to the transmitting portion on said element for rocking therewith and for movement therewith toward and away from the axis of said one of said rockers, said connecting means drivingly interconnecting the transmitting portions of the rockers for thereby causing the degree of opening of the valve to be controllable by positioning said element different distances from the pivotal axis of the rocker on which it is mounted;

power means for driving said element to said normal stroke position from said changed stroke position, and to said changed stroke position from said normal stroke position, respectively; and remote control means, operable while the engine is operating, to cause the power means to drive said element to said positions, selectively, while the timed relation of the first rocker and cam remains unchanged.

2. A valve stroke control device according to claim 1 wherein said engine includes a lineally reciprocable tappet driven by the cam; and said thrust portion of said first rocker is positioned to be engaged in driving relation with one end of the tappet.

3. A valve stroke control device according to claim 1 wherein the engine includes a removable head; the valve is mounted in the head for axial reciprocation; and the second rocker is arranged to be carried by said head.

4. A valve stroke control device according to claim 1 wherein the power means is a reversible piston and cylinder assemblage, including a cylinder member and a piston member reciprocable therein, which assemblage is carried by said one rocker; and one of said members is mounted in fixed position on said one rocker with its axis extending generally transversely of the axis of said one rocker, and the other of said members is said movable element.

5. A valve stroke control device according to claim 4 wherein the power means includes a reversing valve connectable to the output and return sides, respectively, of a pump, and said reversing valve has ports and hydraulic circuit means connecting said cylinder member at opposite sides of the piston member, respectively, to said ports and said reversing valve has a movable control plug for reversing the flow of pressure fluid to, and the return fluid from, opposite sides of the piston member, selectively, depending upon movement of the plug to and from preselected positions.

6. The structure according to claim 1 wherein said engine includes a plurality of additional valves, and a separate one of said transmission means for each valve, each transmission means including one of said assemblages;

a fluid pressure source;

said power means include reversible fluid pressure operated means for said movable elements, respectively, and reversing valve means for connecting all of said pressure operated means, concurrently to said source for thereby driving all of the movable elements concurrently each to its said changed stroke position, and means for reversing the connection of all of said pressure operated means concurrently for returning all of the movable elements concurrently each to its said changed stroke position.

7. The valve stroke control device according to claim 1 wherein said one rocker is the first rocker.

8. The valve stroke control device according to claim 1 wherein said engine has a detachable head and the valves are mounted in the head, and said one rocker is arranged to be mounted on the head.

9. The combination with an internal combustion engine including a plurality of spring closed poppet valves, return springs biasing the valves to closed positions, respectively, cams for the valves, respectively, and transmission means for the valves, respectively, and operable by the associated cams to drive their associated valves to open positions, in timed relation to the engine rotation and to permit return of the valves in timed relation;

and return spring means for the valves, respectively;

of stroke length control devices for the valves, in said transmission means, respectively;

each of said control devices including a first rocker;

first pivot means pivotally connecting the first rocker to the engine for rocking about a pivotal axis fixed in relation to the engine;

said first rocker having a thrust portion spaced a fixed distance from said pivotal axis and through which driving forces of the cam are applied to the first rocker for rocking the first rocker about its said pivotal axis in a valve opening direction in timed coordination with the rotation of the cam, and having a transmitting portion spaced from said thrust portion;

a second rocker for moving the valve to open position and for controlling the return of the valve;

second pivot means pivotally connecting the second rocker to the engine for rocking about a pivotal axis fixed in relation to the engine and spaced from said first pivotal axis;

said second rocker having a transmitting portion spaced from its said pivotal axis and through which the driving force of the cam can be transmitted from the first rocker when the first rocker is rocked in its valve opening direction, and having a valve operating portion spaced from its said transmitting portion;

stroke adjustment means including a movable element mounted on one of said rockers for rocking therewith and for movement generally transversely of the pivotal axis thereof, from a normal stroke position spaced a predetermined distance from said pivotal axis of said one rocker to a changed stroke position which is spaced from said last mentioned axis a different distance than said predetermined distance;

connecting means connected to said element for rocking therewith and for movement therewith toward and away from the axis of said one of said rockers, said connecting means drivingly interconnecting the transmitting portions of the rockers for thereby causing the degree of opening of the valve to be controllable by positioning said element different distances from the pivotal axis of the rocker on which it is mounted;

manually operable, remotely controlled, power means connected to said control devices, respectively, and operable to move all of said elements of said control devices concurrently, each from its said normal stroke position to its said changed stroke position, and selectively, and to move all of said elements concurrently, each from its said changed stroke position to its said normal stroke position, and said power means being so selectively operable while the engine is operating and while the timed relation of each cam and its associated first rocker remains unchanged.

10. The combination according to claim 9 wherein said connecting means for said devices are rigid push rods which are drivingly interposed one between the first and second rockers of each device;

said elements are connected to the push rods, respectively, each element for shifting one end of its associated rod transversely toward and away from the rocking axis of the one of the rockers adjacent to said one end of the push rod to a normal length of stroke position, and to a changed length of stroke position.

11. The combination according to claim 10 wherein the movement of said one end of each rod by its associated element relative to the rocking axis of its said adjacent rocker is effected by swinging said one end of the rod about its opposite end along a path such that the same closed position of the valve is retained in the normal stroke position of the rod and in the changed stroke position of the rod.

12. The combination according to claim 9 wherein said engine has an oil circulating pump driven by the engine;

said stroke control devices each includes a reversible piston and cylinder assemblage including a cylinder member and a piston member reciprocable therein;

one of said members of each assemblage is connected to an associated rocker and the other of said members is connected to the associated connecting means;

fluid pressure supply manifolds are connected to all of said assemblages, one manifold for supplying fluid for driving the piston members concurrently in one direction to provide the normal stroke positions of the valves and the other for supplying fluid for causing the piston members to be returned concurrently in the reverse directions to provide the changed stroke positions of the valves;

a common valve is connected at its inlet to the oil pump and has a return line, and is connected to the manifolds, respectively, and is operable in one operating position to connect one manifold to the inlet and the other manifold to the return line, and in another operating position to connect said other manifold to the inlet and said one manifold to the return line.

* * * * *